US011175084B2

(12) United States Patent
Mitchell

(10) Patent No.: US 11,175,084 B2
(45) Date of Patent: Nov. 16, 2021

(54) HORIZONTAL CLEAR ICE MAKER

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 60 days.

(21) Appl. No.: 16/564,262

(22) Filed: Sep. 9, 2019

(65) Prior Publication Data

US 2021/0071929 A1 Mar. 11, 2021

(51) Int. Cl.

| | |
|---|---|
| ***F25C 5/08*** | (2006.01) |
| ***F25C 1/12*** | (2006.01) |
| ***F25C 1/24*** | (2018.01) |
| ***F25C 1/04*** | (2018.01) |
| ***F25C 5/182*** | (2018.01) |
| ***F25C 1/25*** | (2018.01) |

(52) U.S. Cl.

CPC ..... *F25C 5/08* (2013.01); *F25C 1/04* (2013.01); *F25C 1/12* (2013.01); *F25C 1/24* (2013.01); *F25C 1/25* (2018.01); *F25C 5/182* (2013.01); *F25C 2400/10* (2013.01)

(58) Field of Classification Search

CPC ..... F25C 1/12; F25C 2400/02; F25C 5/08; F25C 1/25; F25C 1/04; F25C 1/24; F25C 1/14; F25C 5/22; F25C 1/18; F25C 2700/06

See application file for complete search history.

(56) References Cited

U.S. PATENT DOCUMENTS

| | | | | |
|---|---|---|---|---|
| 3,163,018 | A | 12/1964 | Shaw | |
| 4,966,015 | A | 10/1990 | Wessa | |
| 6,935,124 | B2 * | 8/2005 | Takahashi | F25C 1/18 62/347 |
| 9,890,986 | B2 | 2/2018 | Boarman | |
| 2011/0023510 | A1 * | 2/2011 | Lee | F25C 1/24 62/137 |
| 2018/0128530 | A1 * | 5/2018 | Mitchell | C02F 1/283 |
| 2019/0338995 | A1 * | 11/2019 | Bertolini | F25C 5/18 |

FOREIGN PATENT DOCUMENTS

JP 2006017401 A 1/2006

* cited by examiner

*Primary Examiner* — Elizabeth J Martin

(74) *Attorney, Agent, or Firm* — Dority & Manning, P.A.

(57) ABSTRACT

An ice maker for an appliance includes a freezing plate having an upwardly facing ice formation surface. A plurality of partitions is positioned on the freezing plate. The plurality of partitions divides the ice formation surface into a plurality of bays. A reservoir is positioned below the freezing plate. A manifold has a plurality of outlets directed towards the plurality of bays on the ice formation surface. A pump is operable to flow water from the reservoir to the manifold. An air conduit is positioned below the freezing plate. The air conduit is configured for guiding a flow of air through the air conduit to chill the freezing plate.

14 Claims, 8 Drawing Sheets

HORIZONTAL CLEAR ICE MAKER

FIELD OF THE INVENTION

The present subject matter relates generally to clear ice makers for appliances.

BACKGROUND OF THE INVENTION

Appliances with ice makers are generally plumbed to a water supply, and water from the water supply flows to the ice maker. Within the ice maker, the water is frozen to form ice. The ice makers are frequently cooled by a sealed system, and heat transfer between liquid water in the ice maker and refrigerant of the sealed system generates the ice.

Certain consumers find clear ice preferable to cloudy ice. In clear ice formation processes, dissolved solids typically found within water, e.g., tap water, are separated out and essentially pure water freezes to form the clear ice. Since the water in clear ice is purer than that found in typical cloudy ice, clear ice is less likely to affect drink flavors.

Forming clear ice with appliances plumbed to water supplies can be challenging. For instance, separated solids from tap water can accumulate and negatively affect ice maker performance.

BRIEF DESCRIPTION OF THE INVENTION

Aspects and advantages of the invention will be set forth in part in the following description, or may be apparent from the description, or may be learned through practice of the invention.

In a first example embodiment, an ice maker for an appliance includes a freezing plate having an upwardly facing ice formation surface. A plurality of partitions is positioned on the freezing plate. The plurality of partitions divides the ice formation surface into a plurality of bays. A reservoir is positioned below the freezing plate. A manifold has a plurality of outlets directed towards the plurality of bays on the ice formation surface. A pump is operable to flow water from the reservoir to the manifold. An air conduit is positioned below the freezing plate. The air conduit is configured for guiding a flow of air through the air conduit to chill the freezing plate.

In a second example embodiment, a refrigerator appliance includes a cabinet defining a chilled chamber. An ice maker is disposed within the cabinet. The ice maker includes a freezing plate having an upwardly facing ice formation surface. A plurality of partitions is positioned on the freezing plate. The plurality of partitions divides the ice formation surface into a plurality of bays. A reservoir is positioned below the freezing plate. A manifold has a plurality of outlets directed towards the plurality of bays on the ice formation surface. A pump is operable to flow water from the reservoir to the manifold. An air conduit is positioned below the freezing plate. The air conduit is configured for guiding a flow of air through the air conduit to chill the freezing plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
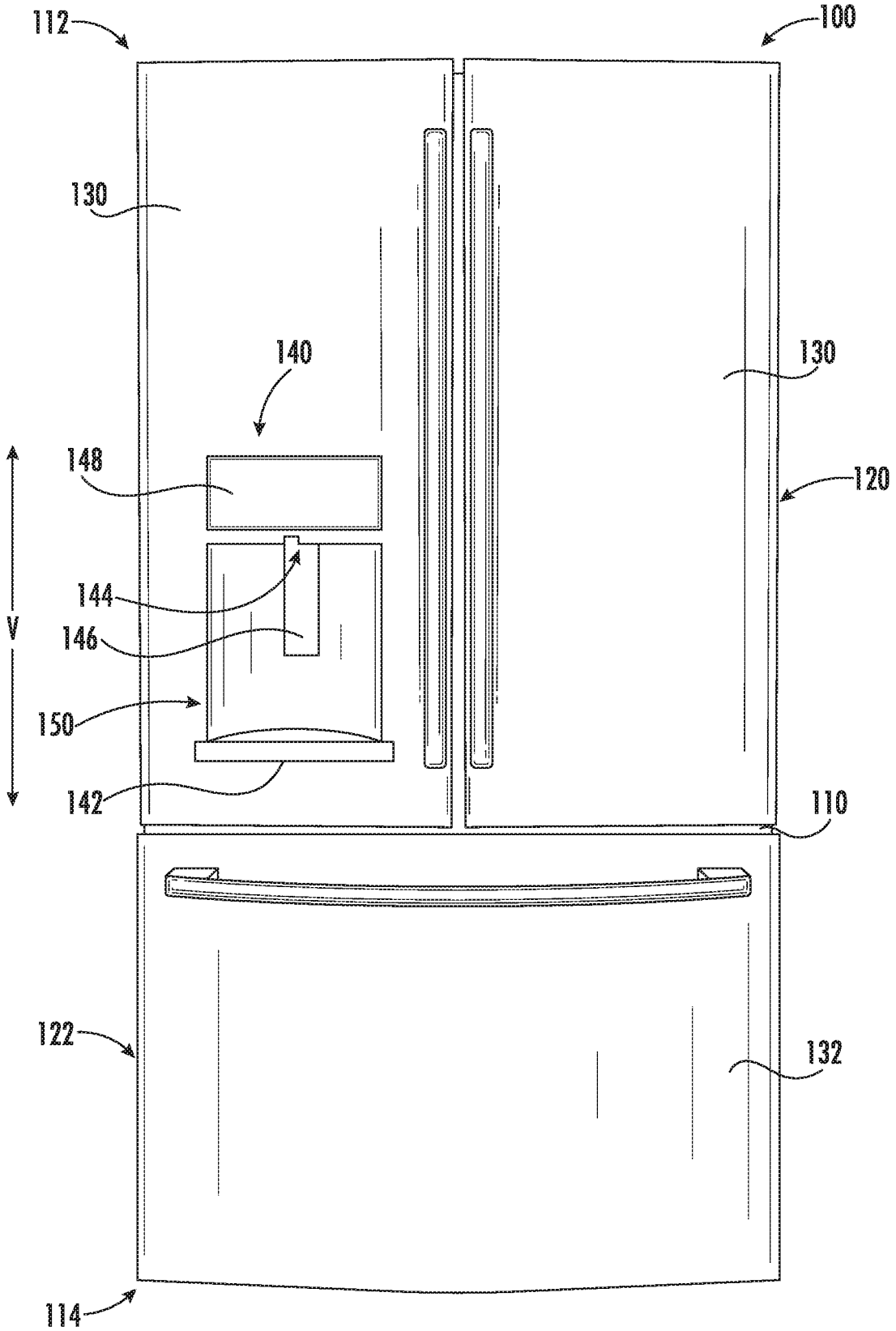
FIG. 1 is a front elevation view of a refrigerator appliance according to an example embodiment.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front elevation view of a refrigerator appliance 100 according to an exemplary embodiment of the present subject matter. Refrigerator appliance 100 includes a cabinet or housing 110 that extends between a top portion 112 and a bottom portion 114 along a vertical direction V. Housing 110 defines chilled chambers for receipt of food items for storage. In particular, housing 110 defines a fresh food chamber 120 positioned at or adjacent top portion 112 of housing 110 and a freezer chamber 122 arranged at or adjacent bottom portion 114 of housing 110. As such, refrigerator appliance 100 is generally referred to as a "bottom mount refrigerator." It is recognized, however, that the benefits of the present disclosure apply to other types and styles of refrigerator appliances such as, e.g., a top mount refrigerator appliance, a side-by-side style refrigerator appliance, or a stand-alone ice maker appliance. Consequently, the description set forth herein is for illustrative purposes only and is not intended to be limiting in any aspect to any particular chilled chamber configuration.

Refrigerator doors 130 are rotatably hinged to an edge of housing 110 for selectively accessing fresh food chamber 120. In addition, a freezer door 132 is arranged below refrigerator doors 130 for selectively accessing freezer chamber 122. Freezer door 132 is coupled to a freezer drawer (not shown) slidably mounted within freezer chamber 122. Refrigerator doors 130 and freezer door 132 are shown in a closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 130. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Figure 2:
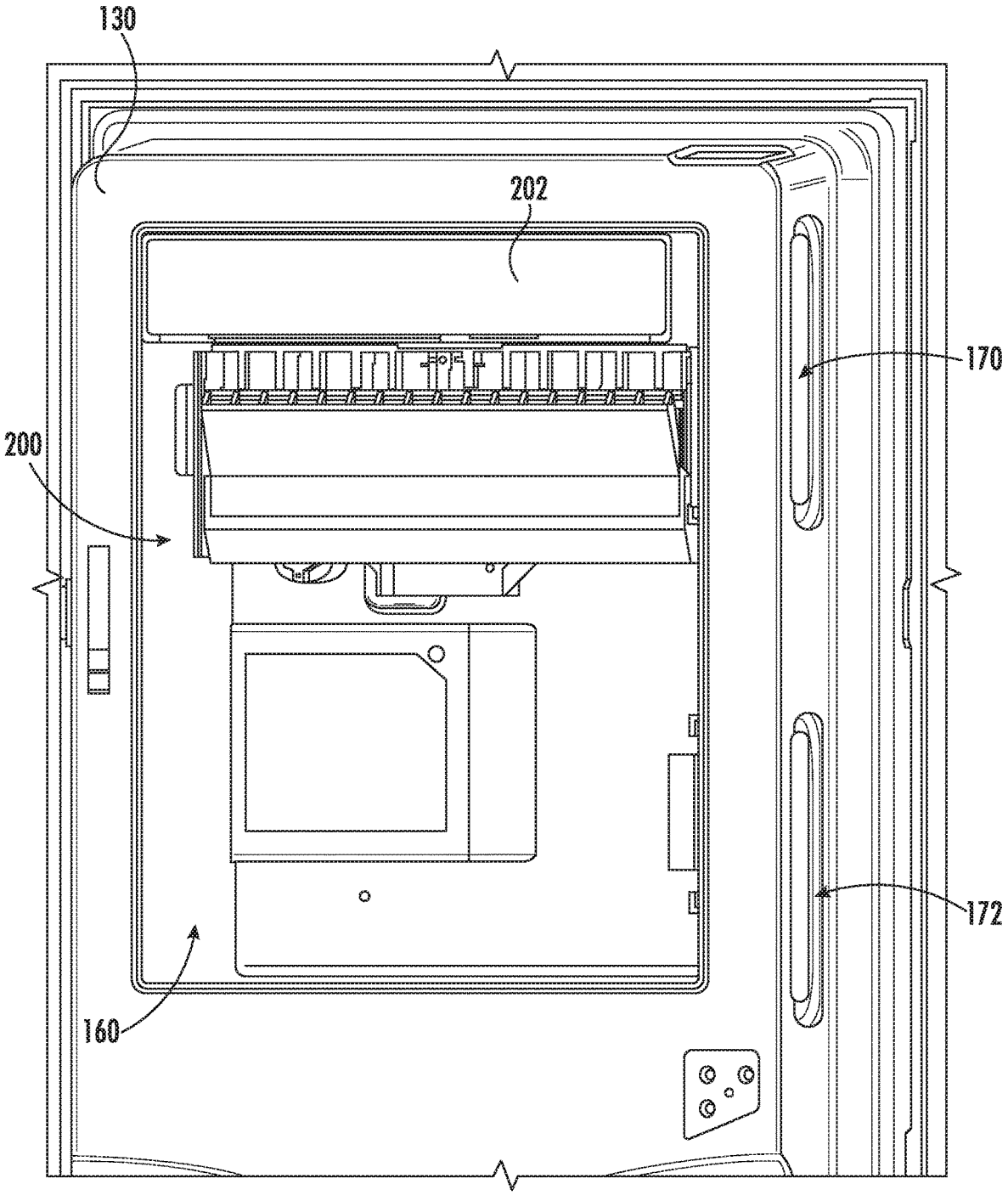
FIG. 2 is a partial, front view of a door of the example refrigerator appliance and an ice maker positioned within the door.

FIG. 2 is a partial, front view of one of refrigerator doors 130. Refrigerator appliance 100 includes a sub-compartment 160 defined on refrigerator door 130. Sub-compartment 160 is often referred to as an "icebox." Sub-compartment 160 is positioned on refrigerator door 130 at or adjacent fresh food chamber 120. Thus, sub-compartment 160 may extend into fresh food chamber 120 when refrigerator door 130 is in the closed position.

Figure 3:
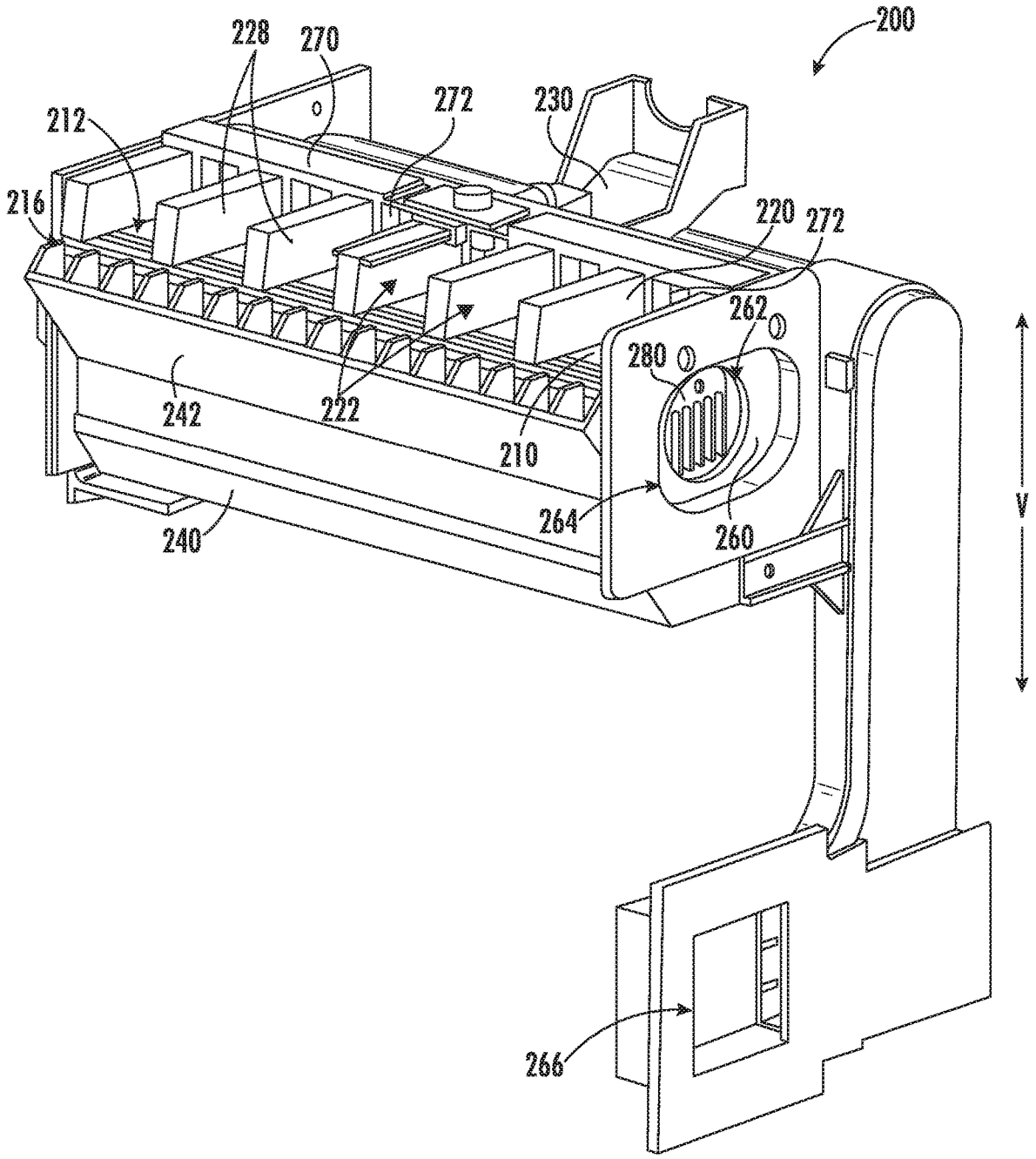
FIG. 3 is a front perspective view of the ice maker of FIG. 2.

As may be seen in FIG. 3, refrigerator appliance 100 includes an icemaker or ice making assembly 200. It will be understood that while described in the context of refrigerator appliance 100, ice making assembly 200 can be used in any suitable refrigerator appliance or stand-alone icemaker appliance. Ice making assembly 200 and an ice storage bin (not shown) are positioned or disposed within sub-compartment 160. Thus, ice is supplied to dispenser recess 150 (FIG. 1) from the ice making assembly 200 and/or the ice storage bin below ice making assembly 200 in sub-compartment 160 on a back side of refrigerator door 130. Chilled air from a sealed system of refrigerator appliance 100 may be directing into ice making assembly 200 in order to cool components of ice making assembly 200. In particular, an inlet 170 on door 128 receives chilled air from the sealed system of refrigerator appliance 100, and the chilled air freezes water within ice making assembly 200, as described in detail below. An outlet 172 on door 128 directs the air back into housing 110.

During operation of ice making assembly 200, chilled air from the sealed system cools components of ice making assembly 200 to or below a freezing temperature of liquid water. Thus, ice making assembly 200 is an air cooled ice making assembly. Chilled air from the sealed system may also cool the ice storage bin within sub-compartment 160. In particular, air around the ice storage bin can be chilled to a temperature above the freezing temperature of liquid water, e.g., to about the temperature of fresh food chamber 120, such that ice cubes in the ice storage bin melt over time due to being exposed to air having a temperature above the freezing temperature of liquid water. In addition, an exterior of ice making assembly 200 may also be exposed to air having a temperature above the freezing temperature of liquid water. As an example, air from fresh food chamber 120 can be directed into sub-compartment 160 such that ice making assembly 200 and/or the ice storage bin is exposed to air from fresh food chamber 120.

Figure 4:
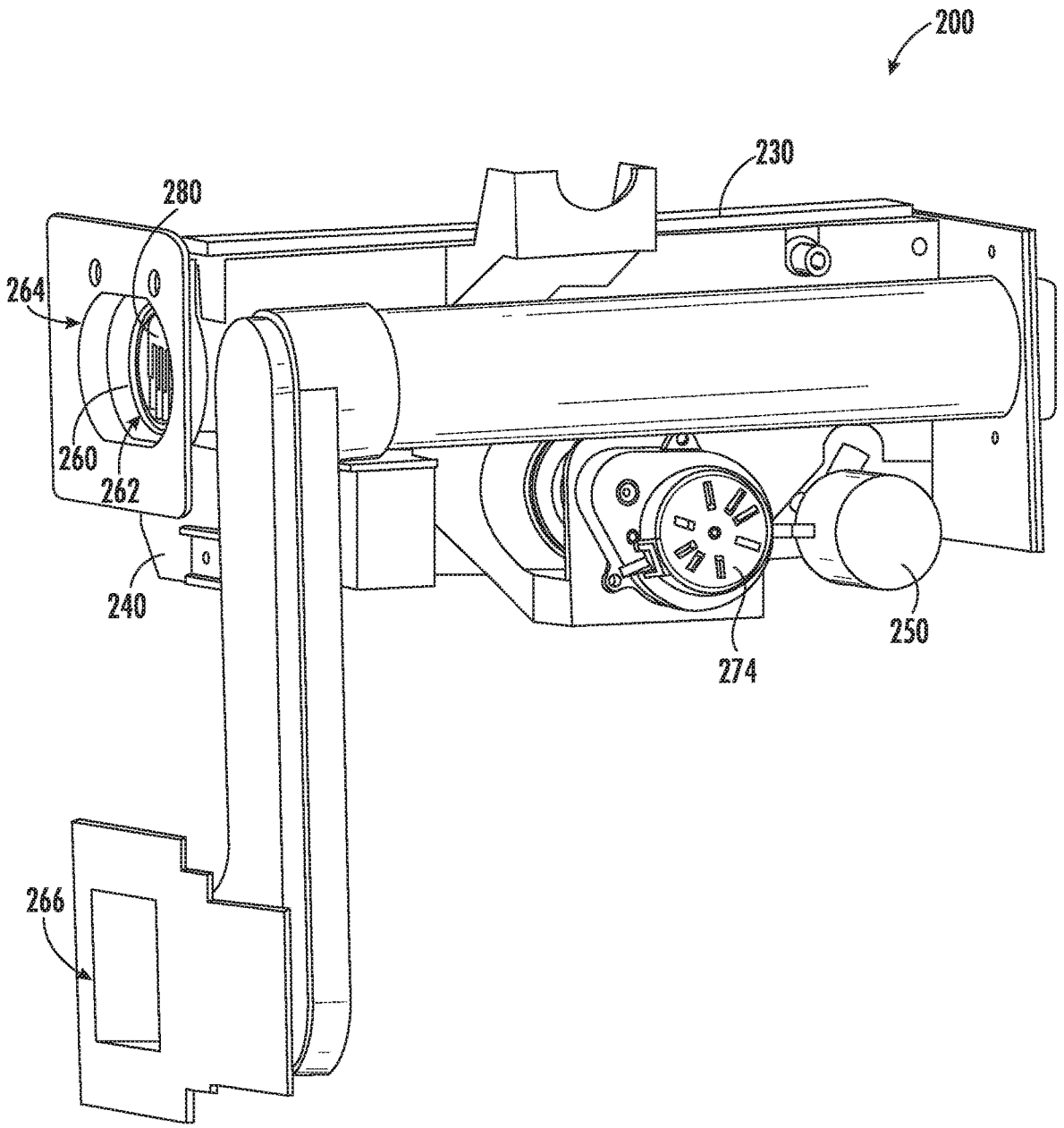
FIG. 4 is a rear perspective view of the ice maker of FIG. 2.
Figure 5:
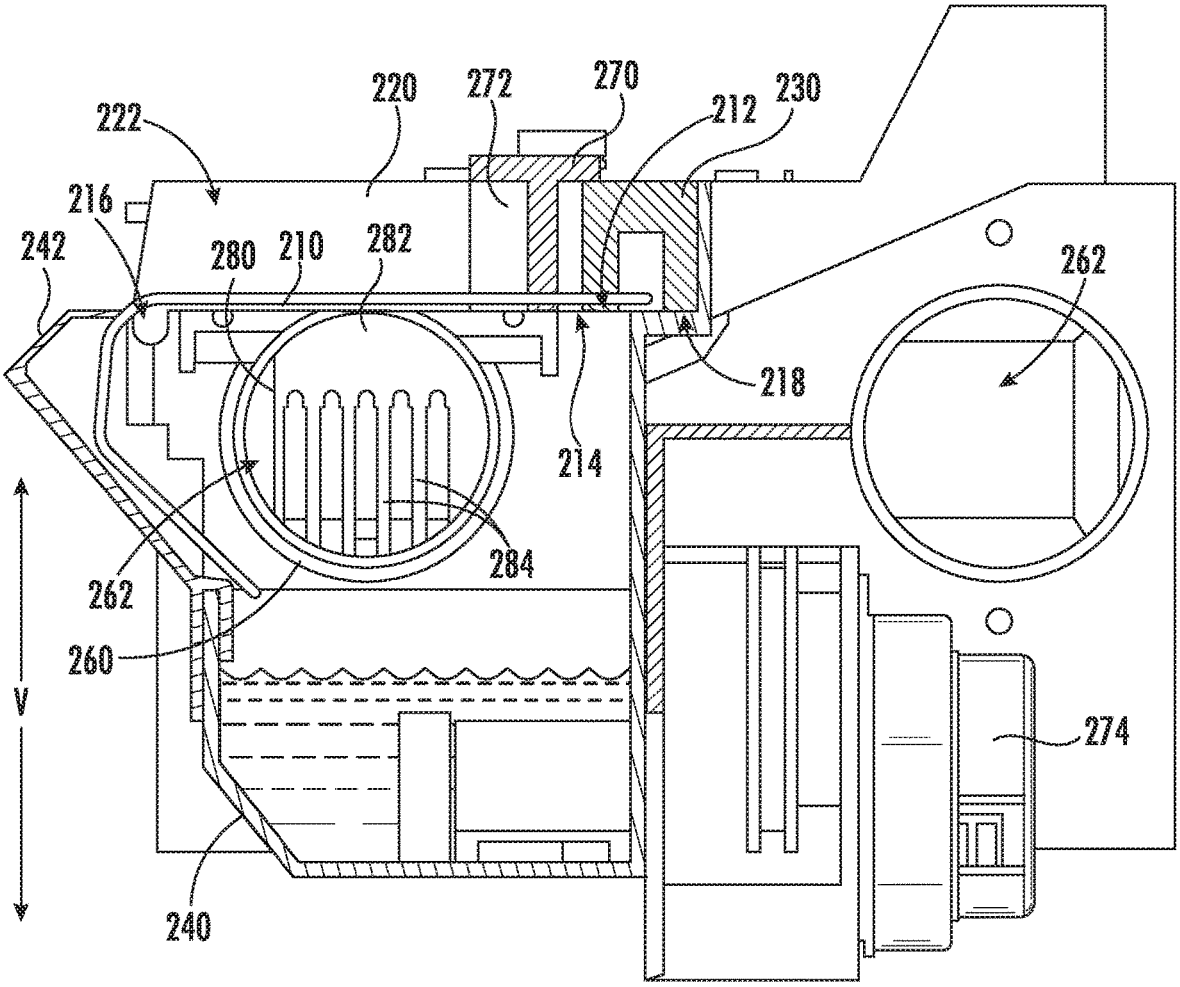
FIGS. 5 through 7 are section view of the ice maker of FIG. 2 during various stages of an ice formation cycle.

FIGS. 3 and 4 are perspective views of ice making assembly 200. With reference to FIGS. 3 and 4, ice making assembly 200 includes an ice formation panel 210. Ice formation panel 210 has a top surface 212 and a bottom surface 214 (FIG. 5). Top and bottom surfaces 212, 214 are positioned opposite each other on ice formation panel 210, e.g., such that top and bottom surfaces 212, 214 face opposite directions. In particular, top surface 212 faces upwardly, e.g., along the vertical direction V. Conversely, bottom surface 214 faces downwardly, e.g., along the vertical direction V. In certain example embodiments, top surface 212 may be oriented such that a tangent of top surface 212 is approximately parallel to the vertical direction V. Thus, top surface 212 may be approximately horizontally oriented. As used herein, the term "about" means within ten degrees (10°) of the stated angle when used in the context of plane orientations.

The above described orientation of top surface 212 has several benefits. For example, when water circulating through ice making assembly 200 is filtered by a deionization filter 202 (FIG. 2) to avoid fouling ice making assembly 200 with deposit buildup, deionized water is frozen to form ice on top surface 212 of ice formation panel 210. The upwardly facing top surface 212 may be more fully and evenly wetted than vertical ice formation panels in known ice makers. Thus, more uniform and cosmetically pleasant ice cubes may be formed with deionized water on upwardly facing top surface 212 as compared to vertical ice formation panels in known ice makers that produce distorted shaped cubes with deionized water.

Ice formation panel 210 may extend between a front portion 216 and a rear portion 218 (FIG. 5). Front and rear portions 216, 218 are, e.g., horizontally, spaced apart from each other. As an example, front and rear portions 216, 218 of ice formation panel 210 may be spaced be no less than one inch (1") and no more than six inches (6"). Conversely, a thickness of ice formation panel 210, e.g., between top and bottom surfaces 212, 214, may be no less than a sixteenth of an inch (1/16") and no more than a quarter of an inch (1/4"), in certain example embodiments.

As may be seen from the above, ice formation panel 210 may have a rectangular shape, e.g., in a plane that is perpendicular to the vertical direction V. Ice formation panel 210 may be constructed of or with any suitable material. For example, ice formation panel 210 may be constructed of or with sheet metal, such as stainless steel. Thus, ice formation panel 210 may be a stainless steel sheet.

Figure 8:
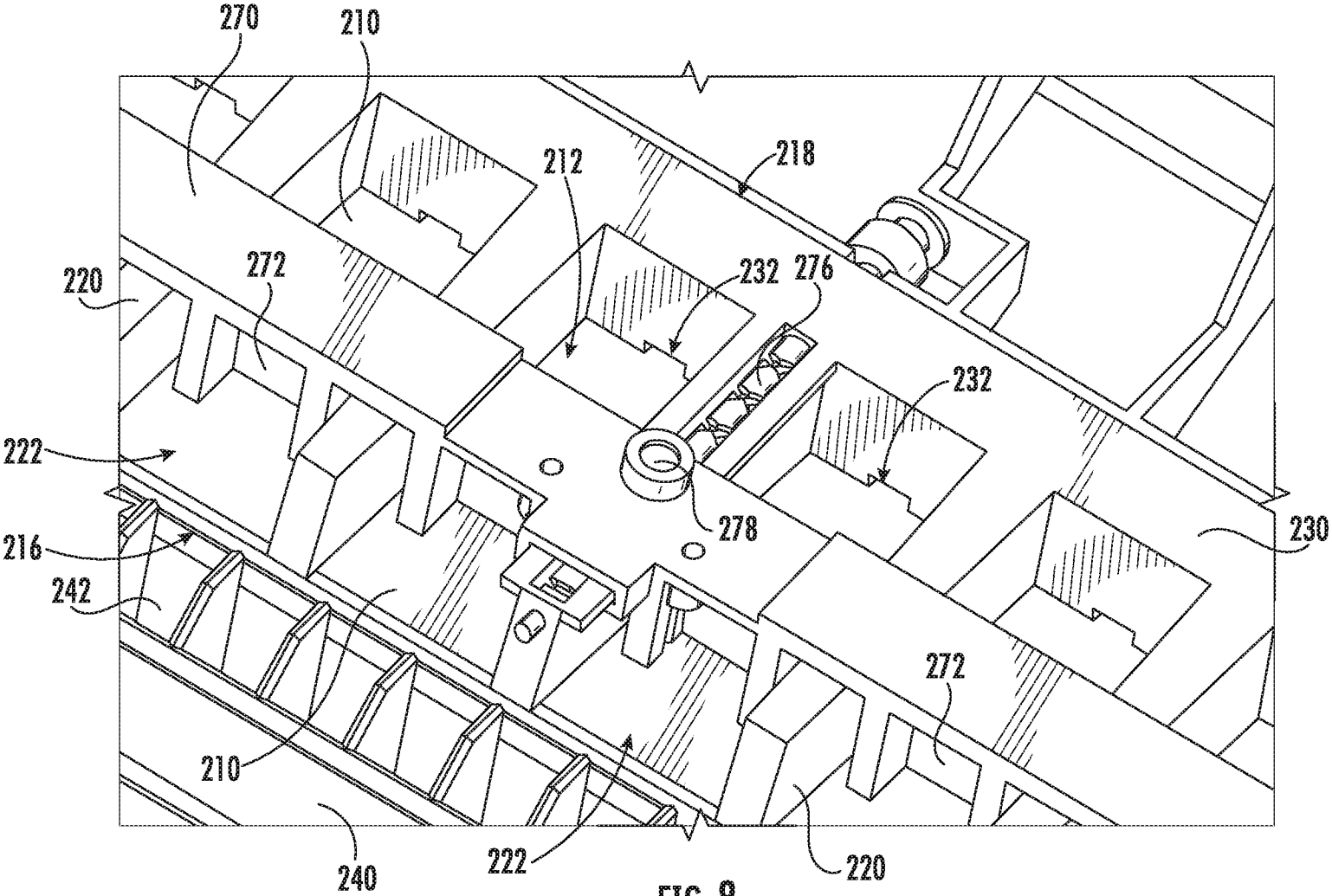
FIG. 8 is a partial perspective view of a harvest assembly of the ice maker of FIG. 2.

Ice making assembly 200 also includes a plurality of partitions 220 and a manifold 230. Partitions 220 are positioned on ice formation panel 210, and partitions 230 divide top surface 212 into a plurality of bays 222. For example, partitions 220 may be laterally spaced on ice formation panel 210 and/or may extend from rear portion 218 towards front portion 216 of ice formation panel 210 to form bays 222. Manifold 230 has a plurality of outlets 232 (FIG. 8) directed towards bays 222 on ice formation panel 210. Water within manifold 239 flows out of each outlet 232 into a respective bay 222. Thus, water from manifold 230 may flow over top surface 212 of ice formation panel 210 within each bay 222. Within bays 222, the water from manifold 230 flowing over top surface 212 of ice formation panel 210 freezes to form clear ice cubes, as discussed in greater detail below. Manifold 230 may be positioned at rear portion 218 of ice formation panel 210, and water exiting outlets 232 may flow from rear portion 218 to front portion 216 of ice formation panel 210 within bays 222.

A reservoir 240 is positioned below ice formation panel 210. Reservoir 240 collects and stores water. In particular, water may flow from ice formation panel 210 at front portion 216 of ice formation panel 210, and reservoir 240 may be positioned to collect the water flowing from ice formation panel 210. A grate 242 may be positioned at front portion 216 of ice formation panel 210. Grate 242 may be positioned between ice formation panel 210 and reservoir 240, and grate 242 may allow liquid water to flow through grate 242 while blocking ice cubes from passing through grate 242 into reservoir 240. Grate 242 may be sloped from ice formation panel 210 towards the ice storage bin below ice making assembly 200 within sub-compartment 160. Thus, grate 242 may direct harvested ice cubes from ice formation panel 210 into the ice storage bin. Reservoir 240 may be sized to hold no less than a half-gallon (½ gal.) of water, in certain example embodiments.

A pump 250 (FIG. 4) is operable to flow water from reservoir 240 to manifold 230. Thus, conduit, piping, etc. may connect manifold 230, reservoir 240 and pump 250 such that pump 250 may draw water from reservoir 240 and urge the water into manifold 230 through such conduit, piping, etc. Deionization filter 202 (FIG. 2) may be positioned above ice formation panel 210 within sub-compartment 160, and deionization filter 202 may be plumbed such that deionization filter 202 is positioned downstream of pump 250 and upstream of manifold 230. Thus, pump 250 may flow water from reservoir 240 through deionization filter 202 prior to flowing such water to manifold 230.

By forming ice cubes on ice formation panel 210 with circulating water, ice cubes produced with ice making assembly 200 can be relatively clear or unclouded, e.g., due to collection of impurities or particles within reservoir 240 and deionization filter 202. In addition, ice making assembly 200 can generate clear ice cubes quickly and/or efficiently, e.g., while occupying a relatively small volume within refrigerator appliance 100.

An air conduit 260 is positioned below ice formation panel 210. Air conduit 260 is configured for guiding a flow of air through air conduit 260 to chill ice formation panel 210 and freeze water flowing on top surface 212 of ice formation panel 210. Thus, air conduit 260 is positioned opposite top surface 212 on ice formation panel 210. Air conduit 260 defines an interior volume 262, an entrance 264 and an exit 266. Air conduit 260 is configured or arranged for receiving a flow of chilled air, e.g., from an evaporator, from inlet 170 on door 128. In particular, the flow of chilled air enters interior volume 262 of air conduit 260 at entrance 264 of air conduit 260 and exits interior volume 262 of air conduit 260 at exit 266 of air conduit 260, e.g., that is positioned at outlet 172 on door 128. Chilled air within interior volume 262 of air conduit 260 can cool ice formation panel 210, e.g., to permit or facilitate ice cube formation on ice formation panel 210, as discussed in greater detail below. Air conduit 260 can be constructed of or with any suitable material. For example, air conduit 260 may be constructed of or with molded plastic. A fan (not shown) may be provided to flow air through air conduit 260.

Ice making assembly 200 can be exposed to or operate within air having a temperature greater than a freezing temperature of liquid water. Thus, liquid water within manifold 230 can be hindered from freezing during operation of ice making assembly 200. However, as discussed above, chilled air within air conduit 260 can permit formation of ice cubes on ice formation panel 210, e.g., despite ice making assembly 200 being exposed to or operating within air having a temperature greater than a freezing temperature of liquid water.

Figure 7:
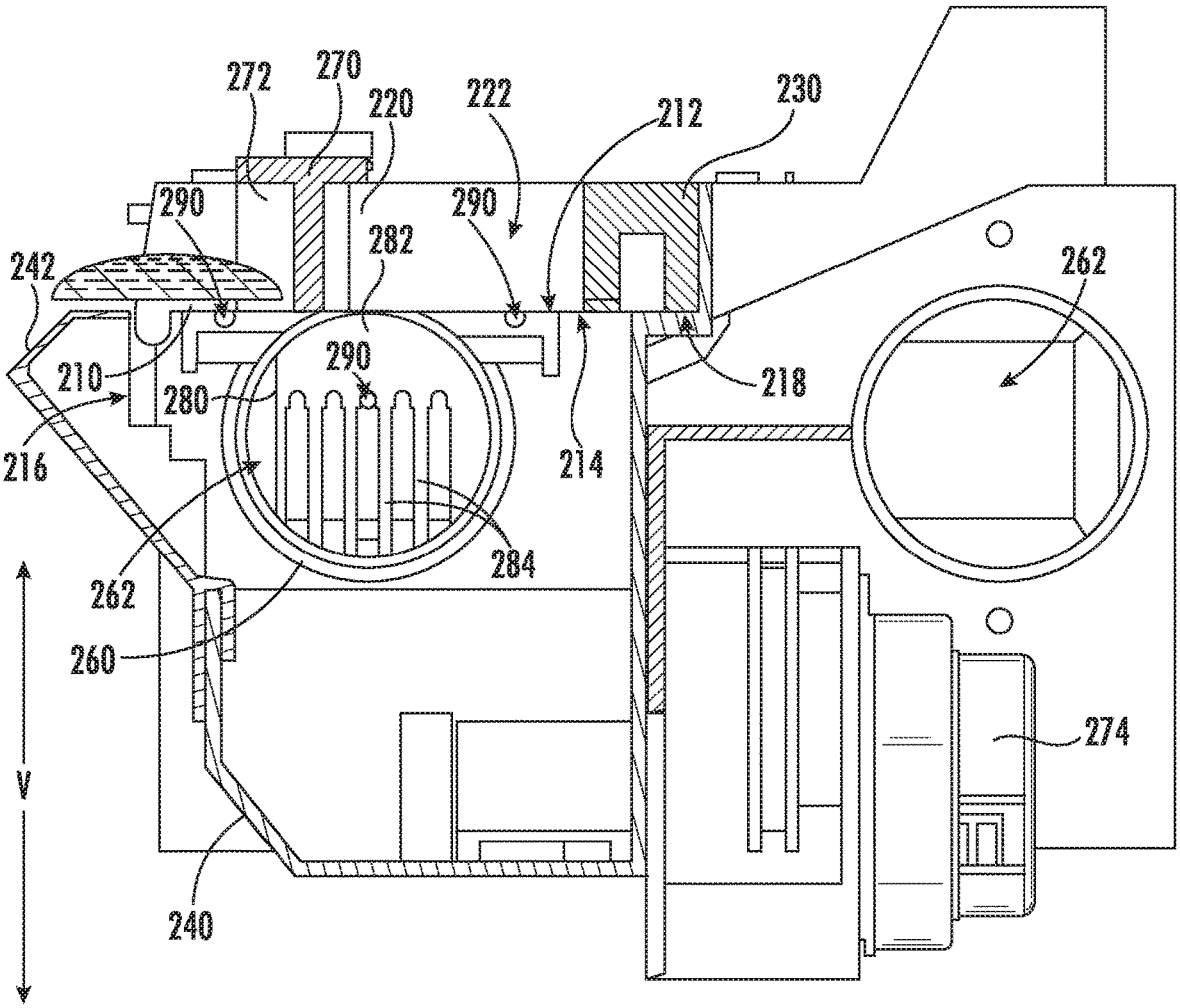

Ice making assembly 200 may also include a rake or sweep 270 for harvesting ice cubes off ice formation panel 210. Sweep 270 has a plurality of tines 272. Each tine 272 is positioned within a respective bay 222. Sweep 270 is positioned above and movable relative to ice formation panel 210. Thus, tines 272 may move within bay 222 to push ice cubes on ice formation panel 210 towards front portion 216 of ice formation panel 210 and/or grate 242. A motor 274 may be coupled to sweep 270. Motor 274 is operable to translate sweep 270 relative to ice formation panel 210. For example, as shown in FIG. 7, ice making assembly 200 may include a traversing cam gear 276 and a follower 278. Traversing cam gear 276 is coupled to and rotatable with motor 274. In particular, a belt may couple a rotor of motor 274 to traversing cam gear 276. Follower 278 is mounted to sweep 270 and meshed with traversing cam gear 276. Rotation of traversing cam gear 276 with motor 274 may translate sweep 270 due to the meshing of follower 278 on sweep 270 to traversing cam gear 276. The gearing on traversing cam gear 276 may allow sweep 270 to move forward and backward over ice formation panel 210 with motor 274 rotating in only one direction.

Figure 6:
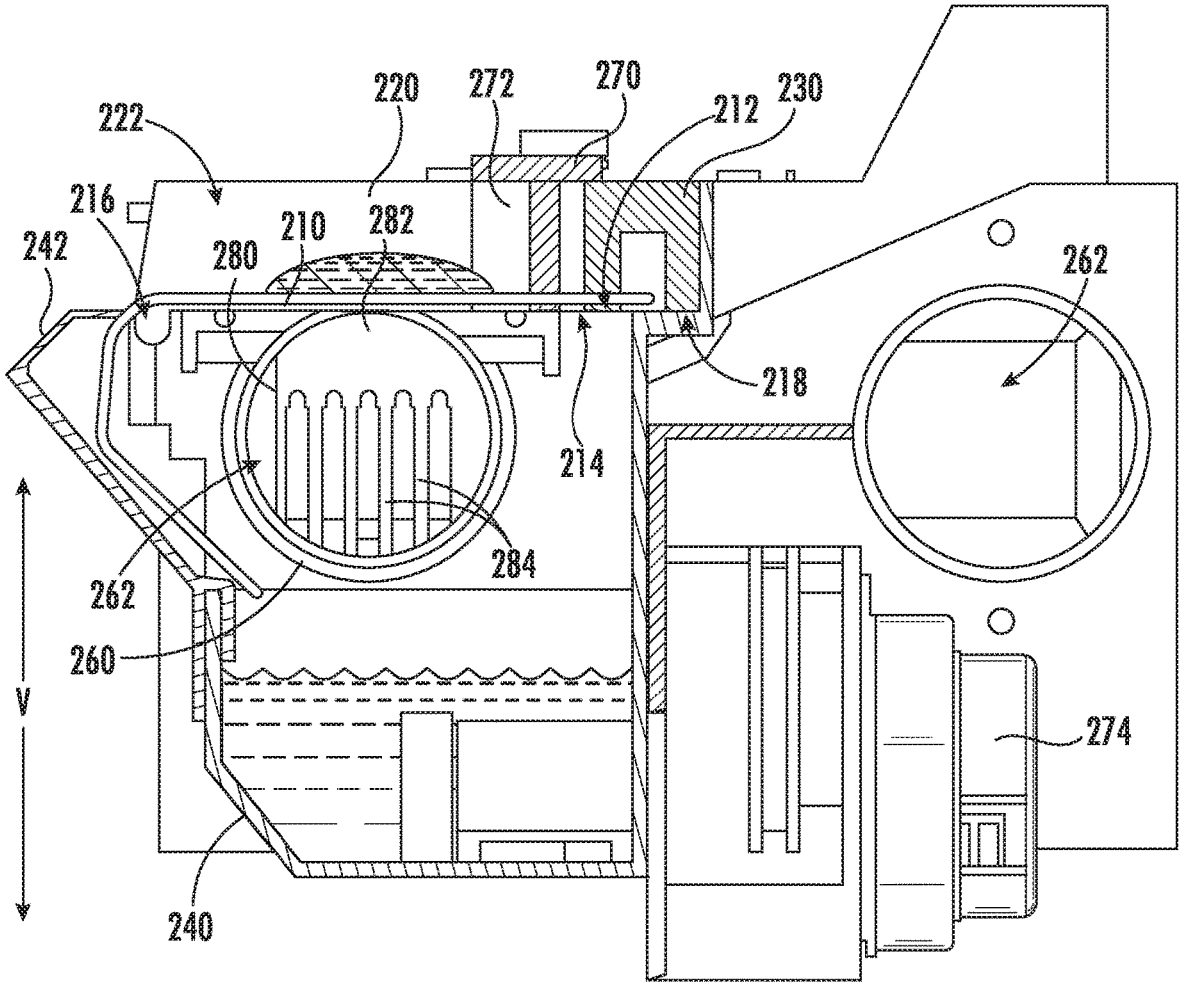

FIGS. 5 through 7 are section view of ice maker assembly 200. As may be seen in FIGS. 5 through 7, ice making assembly 200 may include a heat exchanger 280. Heat exchanger 280 is positioned within air conduit 260 and is connected to ice formation panel 210. Heat exchanger 280 may include a base 282 and a plurality of fins 284. Base 282 may be positioned on and contact ice formation panel 210, and fins 284 may extend from base 282 into air conduit 260. Heat exchanger 280 may facilitate heat transfer between water on top surface 212 of ice formation panel 210 and air within air conduit 260. Thus, heat exchanger 280 can be constructed of or with any suitable, e.g., conductive, material. For example, heat exchanger 280 may be constructed of or with aluminum or stainless steel.

FIGS. 5 through 7 are section view of ice maker assembly 200 during various stages of an ice formation cycle. Operation of ice maker assembly 200 will be discussed below in the context of FIGS. 5 through 7. As shown in FIG. 5, at a start of the ice formation cycle, pump 250 may be activated to flow liquid water from reservoir 240 to manifold 230. From manifold 230 the water flows horizontally over top surface 212 of ice formation panel 210 from rear portion 218 to front portion 216 of ice formation panel 210. As the water flows over ice formation panel 210, chilled air is also flowing through air conduit 260. The water on ice formation panel 210 rejects heat to the chilled air in air conduit 260 and freezes on ice formation panel 210 over air conduit 260, as shown in FIG. 6. Thus, ice cubes may be formed on ice formation panel 210 by, e.g., simultaneously, flowing water on ice formation panel 210 and chilled air through air conduit 260. As noted above, more uniform and cosmetically pleasant ice cubes may be formed with deionized water on upwardly facing top surface 212 as compared to vertical ice formation panels in known ice makers that produce distorted shaped cubes with deionized water. In addition, deionization filter 202 may allow operation of ice maker assembly 200 without a drain, i.e., ice maker assembly 200 may be a drainless ice maker assembly. Thus, water within ice maker assembly 200 need not be flushed to a drain in order to remove accumulated deposits from within ice maker assembly 200.

To harvest the ice cubes on ice formation panel 210, pump 250 may be deactivated to terminate the flow of liquid water over ice formation panel 210, and the flow of chilled air through air conduit 260 may also be terminated, e.g., by deactivating an associated fan. One or more electric resistance heating elements 290 (FIG. 7) connected to ice formation panel 210, e.g., below ice formation panel 210, may also be activated to heat ice formation panel 210. The electric resistance heating elements 290 may be positioned on bottom surface 214 of ice formation panel 210 and/or heat exchanger 280. By stopping the flow of chilled air through air conduit 260 and/or activing electric resistance heating elements 290, the ice cubes on ice formation panel 210 may slightly melt and separate from ice formation panel 210. Motor 274 may then be activated to move sweep 270 relative to ice formation panel 210, e.g., such that tines 272 move within bay 222 to push ice cubes on ice formation panel 210 towards front portion 216 of ice formation panel 210 and/or grate 242, as shown in FIG. 7. The harvested ice cubes are stored within the ice storage bin in sub-compartment 160. Motor 274 remains activated until sweep 270 moves back to the rear portion 218 of ice formation panel 210 at which point the ice formation cycle is complete and may be repeated to form more ice cubes on ice formation panel 210 in the manner described above.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker for an appliance, comprising:

a freezing plate having an upwardly facing ice formation surface;

a plurality of partitions positioned on the freezing plate, the plurality of partitions dividing the ice formation surface into a plurality of bays;

a sweep having a plurality of tines, each tine of the plurality of tines positioned within a respective bay of the plurality of bays;

a motor coupled to the sweep, the motor operable to translate the sweep relative to the freezing plate;

a reservoir positioned below the freezing plate;

a manifold having a plurality of outlets directed towards the plurality of bays on the ice formation surface;

a pump operable to flow water from the reservoir to the manifold; and an air conduit positioned below the freezing plate, the air conduit configured for guiding a flow of air through the air conduit to chill the freezing plate, wherein the upwardly facing ice formation surface is horizontally oriented.

2. The ice maker of claim 1, further comprising a heat exchanger positioned within the air conduit and connected to the freezing plate, the heat exchanger comprising a plurality of fins extending into the air conduit.

3. The ice maker of claim 1, further comprising an electric resistance heating element connected to the freezing plate.

4. The ice maker of claim 1, further comprising a traversing cam gear and a follower, the traversing cam gear rotatable with the motor, the follower mounted to the sweep and meshed with the traversing cam gear.

5. The ice maker of claim 1, further comprising a deionization filter positioned above the freezing plate, the deionization filter positioned upstream of the pump and downstream of the manifold.

6. The ice maker of claim 1, further comprising a grate positioned at a front edge of the freezing plate.

7. The ice maker of claim 1, wherein the ice formation surface is planar, and a tangent of the ice formation surface is about vertical.

8. A refrigerator appliance, comprising:

a cabinet defining a chilled chamber; and an ice maker disposed within the cabinet, the ice maker comprising a freezing plate having an upwardly facing ice formation surface, a plurality of partitions positioned on the freezing plate, the plurality of partitions dividing the ice formation surface into a plurality of bays, a sweep having a plurality of tines, each tine of the plurality of tines positioned within a respective bay of the plurality of bays, a motor coupled to the sweep, the motor operable to translate the sweep relative to the freezing plate, a reservoir positioned below the freezing plate, a manifold having a plurality of outlets directed towards the plurality of bays on the ice formation surface, a pump operable to flow water from the reservoir to the manifold, and an air conduit positioned below the freezing plate, the air conduit configured for guiding a flow of air through the air conduit to chill the freezing plate, wherein the upwardly facing ice formation surface is horizontally oriented.

9. The refrigerator appliance of claim 8, wherein the ice maker further comprises a heat exchanger positioned within the air conduit and connected to the freezing plate, the heat exchanger comprising a plurality of fins extending into the air conduit.

10. The refrigerator appliance of claim 8, wherein the ice maker further comprises an electric resistance heating element connected to the freezing plate.

11. The refrigerator appliance of claim 8, wherein the ice maker further comprises a traversing cam gear and a follower, the traversing cam gear rotatable with the motor, the follower mounted to the sweep and meshed with the traversing cam gear.

12. The refrigerator appliance of claim 8, wherein the ice maker further comprises a deionization filter positioned above the freezing plate, the deionization filter positioned upstream of the pump and downstream of the manifold.

13. The refrigerator appliance of claim 8, wherein the ice maker further comprises a grate positioned at a front edge of the freezing plate.

14. The refrigerator appliance of claim 8, wherein the ice formation surface is planar, and a tangent of the ice formation surface is about vertical.

* * * * *